United States Patent [19]

Kemmann

[11] Patent Number: 4,810,033

[45] Date of Patent: Mar. 7, 1989

[54] ADJUSTABLE BACKREST

[75] Inventor: Paul G. Kemmann, Am Lieversholz, Fed. Rep. of Germany

[73] Assignee: Kemman & Koch, Velbert, Fed. Rep. of Germany

[21] Appl. No.: 154,944

[22] Filed: Feb. 11, 1988

[30] Foreign Application Priority Data

Feb. 12, 1987 [DE] Fed. Rep. of Germany ..... 8702174

[51] Int. Cl.[4] ..... A47C 3/00; A47C 7/02

[52] U.S. Cl. ..... 297/284; 297/460

[58] Field of Search ..... 297/284, 460

[56] References Cited

U.S. PATENT DOCUMENTS 3,720,441 3/1973 Corchran ..... 297/284
4,182,533 1/1980 Arndt ..... 297/284
4,295,681 10/1981 Gregory ..... 297/284
4,313,637 2/1982 Barley ..... 297/284
4,541,670 9/1985 Morgenstern et al. ..... 297/284

FOREIGN PATENT DOCUMENTS 2345254 4/1974 Fed. Rep. of Germany ..... 297/284

*Primary Examiner*—James T. McCall
*Attorney, Agent, or Firm*—Austin R. Miller

[57] ABSTRACT

Disclosed is an adjustable chair backrest having a frame and deformable material covering one side of the frame. A pressure having a rigid lower portion and an elastically deformable upper portion is mounted on a cam. The plate and cam pivot about an axis in response to rotation of a spindle to cause outward movement of the deformable material.

5 Claims, 4 Drawing Sheets

ADJUSTABLE BACKREST

The invention relates to an adjustable backrest of an armchair, seating furniture or the like.

Chairs or armchairs with a backrest designed with ergonomic factors in mind, although improving the sitting posture, nevertheless can be matched to individual needs only by adjusting the inclination of the backrest relative to the seat surface.

The object on which the invention is based is to construct a backrest of an armchair or the like, in such a way that the ergonomic design of the backrest can be matched more closely to the particular needs of the user.

This object is achieved by means of the features of the characterizing clause of claim 1. As a result of the portion which is adjustable and deformable by means of an adjusting device and which is arranged in the backrest especially at the level of the kidneys, the shape of the backrest can be matched or adjusted to individual conditions or demands.

Advantageous embodiments of the invention are indicated in the following description and in the further claims.

Exemplary embodiments of the invention are explained in detail below with reference to the drawing. In the drawings.

Figure 4:
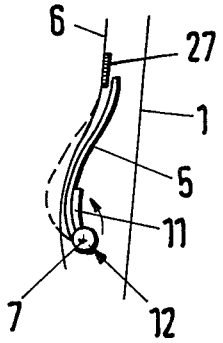
Figure 5:
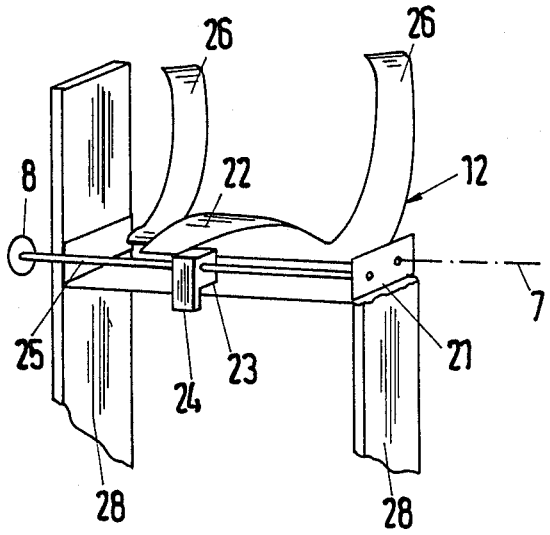
Figure 6:
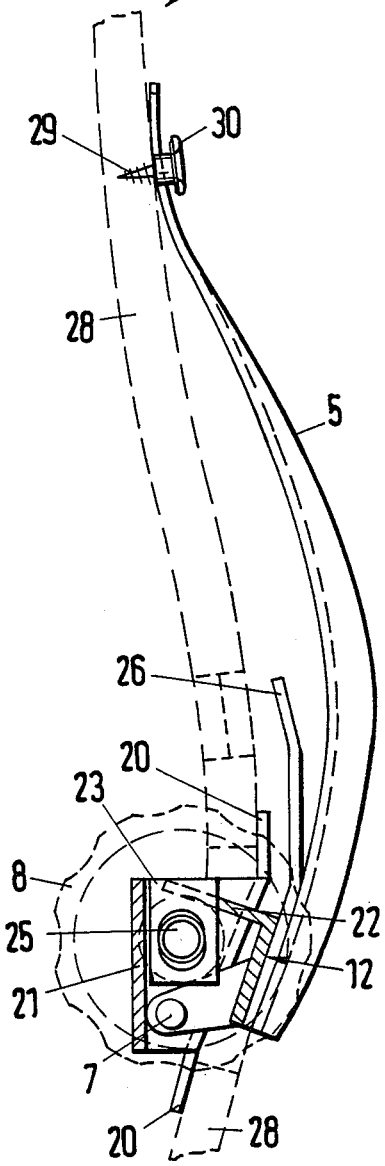
Figure 7A:
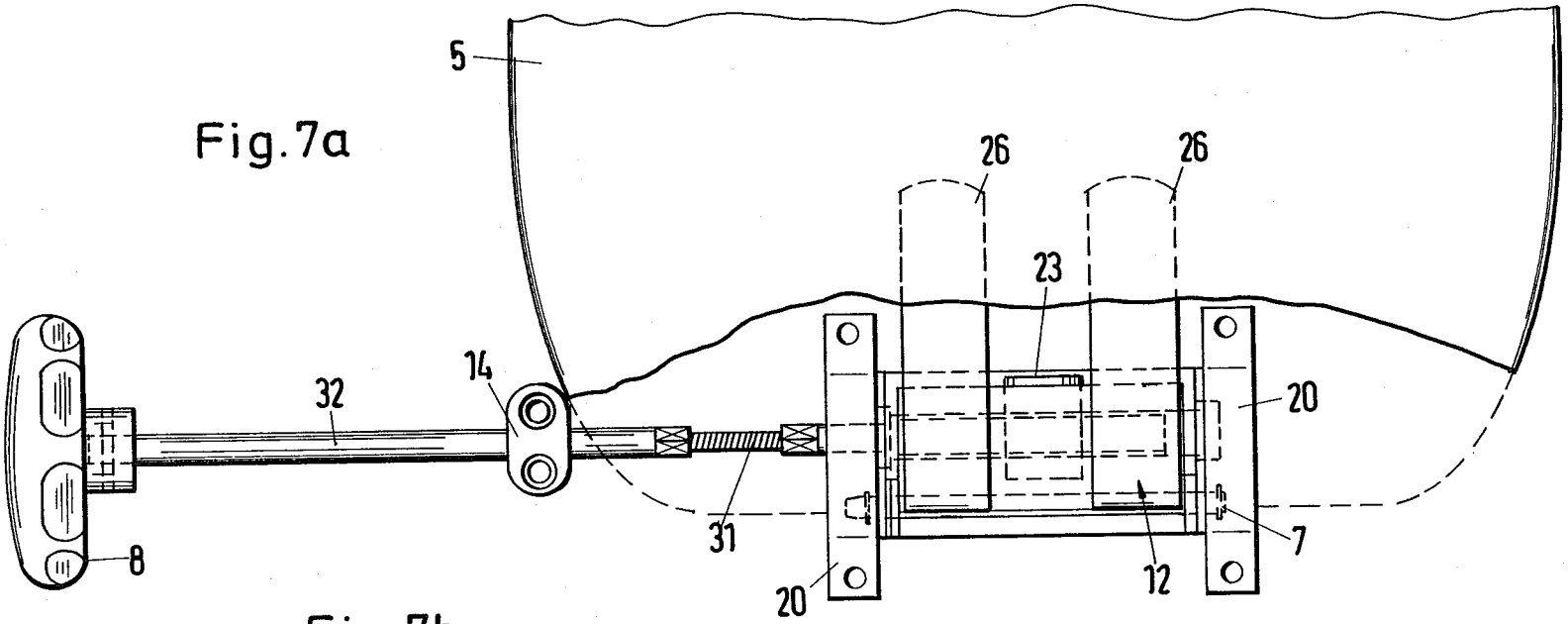
Figure 7B:
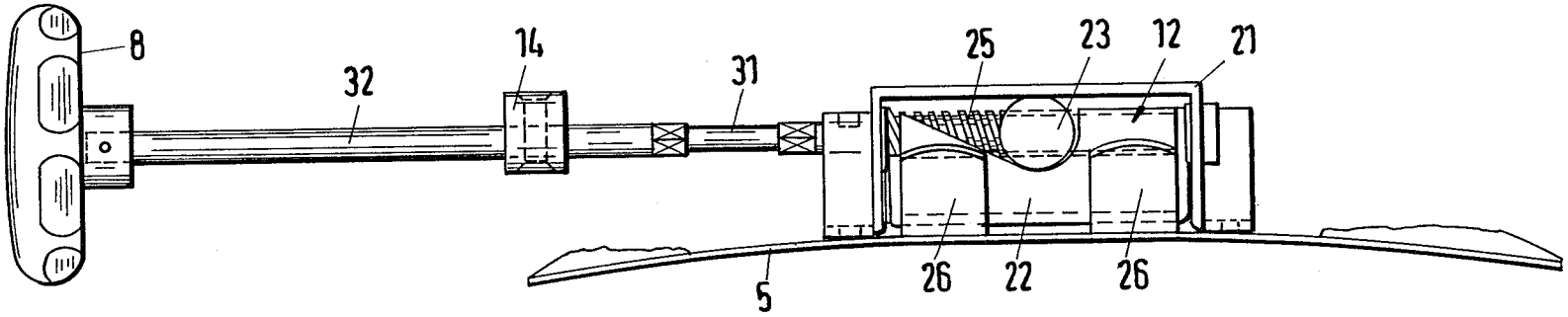
Figure 8:
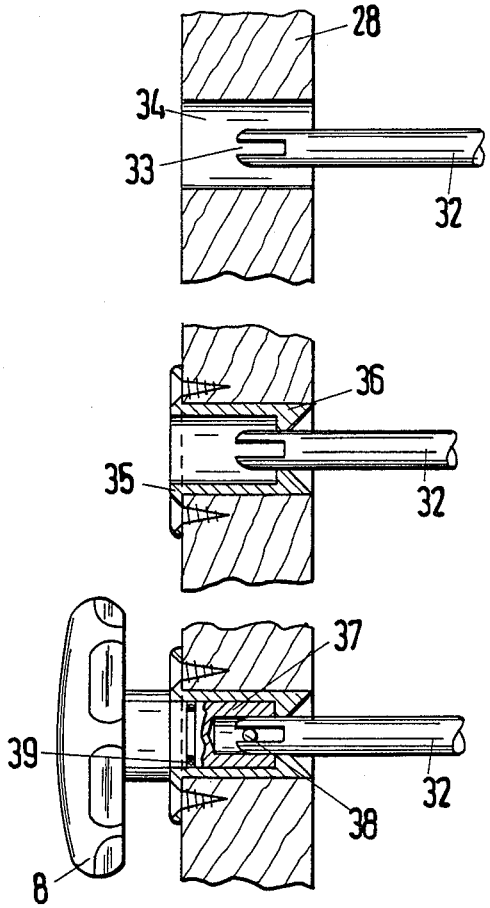

FIGS. 3 *a, b* show front views of a pressure plate,

FIG. 4 shows a diagrammatic side view of the pressure plate with part of the adjusting device, FIG. 5 shows a perspective, simplified representation of an adjusting device, FIG. 6 shows a side view with a part section of a practical embodiment of the adjusting device according to FIG. 5, FIG. 7*a* shows a front view of the adjusting device according to FIG. 6 and FIG. 7*b* shows a plan view of this adjusting device, and FIG. 8 shows the fastening of the adjusting or rotary knob.

Figure 1:
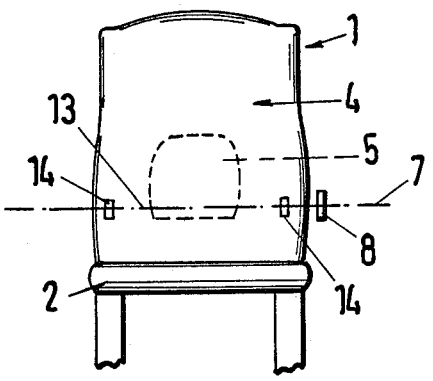
FIG. 1 shows diagrammatically a front view of a chair.

In FIG. 1, 1 denotes the backrest and 2 the seat of an armchair, and here the backrest 1 can be arranged rigidly relative to the seat 2 or can be adjusted in terms of its inclination via a joint indicated diagrammatically at 3.

Figure 2:
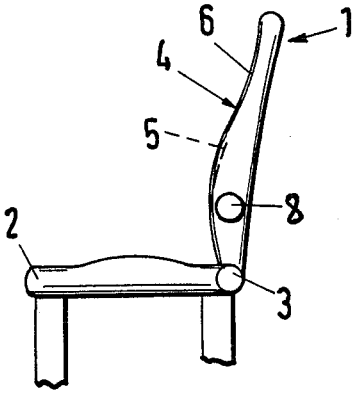
FIG. 2 shows a side view of the chair.

Arranged in the bearing surface 4 of the backrest 1, approximately level with the kidneys and in the middle region, is a pressure plate 5 which consists of a deformable material and which can be deformed and adjusted relative to the bearing surface 4 by means of an adjusting device. The pressure plate 5 is covered with the covering material 6 or with upholstery of the backrest 1, so that it is invisible from outside. At the bottom part, the pressure plate 5 is pivotable, for example by means of a rotary knob 8, which is accessible from outside the backrest, about an axis indicated at 7 in FIGS. 1 and 2.

Figure 3A:
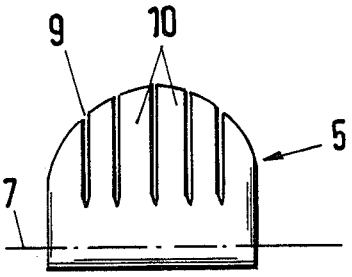

FIG. 3*a* shows a view of a pressure plate 5 consisting, for example, of a deformable plastic plate which, for easier deformability, is provided with incisions 9 over most of its height, thereby producing individual resilient lamellae 10 which rest against the covering material 6, as shown in FIG. 4. The pressure plate 5 or the lamellae 10 can be preformed with a specific curvature in the form illustrated in FIG. 4.

Figure 3B:
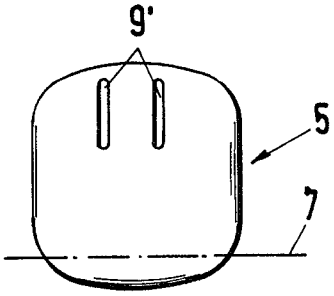

FIG. 3*b* shows a front view of a pressure plate 5 which is rotatable about the axis 7 in the lower edge portion and which is equipped, in the upper portion, with two parallel guide slots 9′ lying perpendicularly to the axis 7 and closed at the upper edge in contrast to the incisions 9. Retention means 29 engage into these incisions 9 or guide slots 9′, as shown in FIG. 6.

The pressure plate 5 is designed so that it is rigid or less easily deformable in the lower portion adjacent to the pivot axis 7, whereas in the remaining region up to the top edge it is flexible or more easily deformable. A material having resilient properties is preferably chosen. This deformability differing over the height of the pressure plate can be obtained by forming lamellae, as indicated in FIG. 3*a*, or because the pressure plate 5 has a specific thickness in the lower portion and becomes increasingly thin towards the top edge.

In the embodiment according to FIG. 4, the pressure plate 5 has for example a continuously uniform thickness, and in the lower portion it is fastened to an appropriately shaped sheet-like portion 11 of a pivoting part 12 which is mounted fixed in place in the backrest 1 and which is pivotable about the axis 7. For example, the pivoting part 12 can be equipped with a shaft 13 which is indicated diagrammatically in FIG. 1 and which is mounted rotatably in bearings 14 fastened in the rigid part of the backrest 1. This shaft 13 can be connected, on the outside, to a rotary knob 8 which is displaceable relative to the shaft 13 in the axial direction and which is spring-loaded, so that a locking device not shown in detail can be provided between the rotary knob 8 and the backrest 1, with the result that the pivoting position of the shaft 13 can be fixed in in the respective settings.

If, in the view according to FIG. 4, the pivoting part 12 is pivoted in the direction of the arrow, the more rigid lower portion of the pressure plate 5 is pressed harder outwards against the covering material 6, whilst the softer upper portion of the pressure plate 5 is restrained to a greater extent as a result of the tension of the covering material 6, so that it cannot follow the pivoting movement of the lower portion completely. An increased curvature of the pressure plate 5 is obtained in this way, as represented by broken lines in FIG. 4.

Between the upper edge of the pressure plate 5 and the covering material 6, a support, indicated at 27 in FIG. 4, can be provided for the free edge of the pressure plate 5, and this support 27 can be part of the frame of the backrest 1. By means of this support 27, the upper free edge can be held in the pivoting direction during the pivoting of the pivoting part 12 or of the lower portion of the pressure plate 5, so that the free edge shifts somewhat only in the plane of this support 27, whilst the curvature of the middle portion of the pressure plate 5 is changed. According to a design modification, the slots 9′ in FIG. 3*b* can be engaged with projections on the rear side of the support plate 27. This prevents the free edge of the pressure plate 5 from shifting so far downwards relative to the bottom edge of the support plate 27 that it can come loose from this support. At the same time, a stop for the outward curving of the pressure plate is provided thereby.

According to FIG. 5, there is a pivoting part 12 which is shaped from sheet metal or plastic and which is mounted pivotably, by means of its pivot pin 7, on a carrier 21 fastened, for example, in the frame of the backrest 1. This pivoting part 12 is equipped with two lateral supporting arms 26, on which the pressure plate 5 rests or is fastened and which correspond to portion 11 in FIG. 4. Formed between these supporting arms 26 is a cam portion 22 resting against a nut 23 which is supported fixedly in terms of rotation on the carrier 21 via a stop 24 and which is adjustable along a threaded spindle 25 mounted rotatably in the carrier 21 and connected to a rotary knob 8. When the rotary knob 8 is rotated, the nut 23 is consequently shifted in the axial direction of the threaded spindle, the pivoting part 12 being pivoted via the cam portion 22. It is also possible, at the same time, to provide on the cam portion an engagement part, for example a groove which is engaged with a corresponding engagement part, for example a lug, on the nut 23, so that no spring-loading of the pivoting part 12 is required for the pivoting movement of the pivoting part 12 about the axis 7. Conventionally, however, the elasticity of the covering material is sufficient for the return of the pivoting part 12 or pressure plate 5.

FIG. 6 shows an embodiment corresponding to FIG. 5, in which screwed in the wooden frame 28 of the backrest 1 are one or more retention means 29 which each have a shank and a widened head 30. By means of the shank, this retention means engages into one of the slit-like incisions 9 or slots 9' of the thrust plate 5, whilst the widened head part 30 engages over the lateral edges of the incision 9 or of the lamellae 10 lying next to one another. The top edge of the pressure plate 5 is thus held up against the wooden frame 28 of the backrest 1, whilst the lower portion of the pressure plate can be curved further outwards.

The pressure plate 5 illustrated in FIG. 6 consists of a plastic plate of the same continuous thickness, the incisions 9 extending approximately over the upper third of the height of the plate. The pressure plate 5 is preformed in the approximately S-shaped side view shown in FIG. 6, and in addition a curvature perpendicular to the drawing plane can be preformed, as represented by the broken lines. However, it is also possible to provide a plate 5 which is plane in the relaxed state.

In FIGS. 6 and 7, the same reference symbols as in FIG. 5 are used for identical or corresponding components. The pivoting part 12 comprises an angle bar, on one leg of which the cam portion 22 is formed, whilst the supporting arms 26 are fastened to the other leg. The pressure plate 5 is fastened to the pivoting part 12 by means of the lower edge, and in the pivoting position of the pressure plate 5 shown in FIG. 6 the supporting arms 26 do not yet rest against the pressure plate which is first curved outwards simply as a result of the pivoting of the pivoting part 12. Under more pronounced outward curving, the supporting arms 26 come to rest against the pressure plate 5.

The carrier 21 is fastened in a perforation in the wooden frame 28 by means of extensions 20, as shown in FIGS. 6 and 7*a*. In contrast to the diagrammatic representation according to FIG. 5, the pivot axis 7 and the threaded spindle 25 are arranged above one another in the carrier 21. The threaded spindle 25 is followed by a flexible shaft portion 31, to which is fastened a rigid shaft 32 which is mounted rotatably on the frame of the backrest at 14.

FIG. 7*b* illustrates the relaxed position of the pressure plate 5. As a result of the rotation of the rotary knob 8 in a clockwise direction, the nut 23 is moved to the left in FIG. 7*b*, with the result that the pivoting part 12 is pivoted outwards by the cam portion 22 and the pressure plate 5 is thereby curved, as shown in FIG. 6.

FIG. 8 shows an embodiment of the fastening of the rotary knob 8 to the shaft 32 which, at the engagement end, has a slot 33 extending in the axial direction. This end of the shaft 32 provided with a slot projects into a bore 34 in the frame 28 of the backrest. After the side part of the backrest has been upholstered, a covering and bearing sleeve 35 is inserted into the bore 34 and fastened to the frame 28 at a flange portion by means of screws. The sleeve 35 has a centering portion 36 for centering the shaft 32. Slipped onto this is the rotary knob 8 which is equipped with a hub 37 provided with an inner bore. A pin 38 leads transversely through the bore in the hub 37 and engages into the slot 33 in the shaft 32. A spring ring 39 is arranged in an annular groove on the outer periphery of the hub 37, engages with the inner periphery of the sleeve 35 and holds the rotary knob 8. This device makes assembly simpler. FIG. 7 illustrates a simple connection of the rotary knob 8 to the shaft 32 by means of a crosspin.

In the embodiment according to FIGS. 6 and 7, the fastening of the lower edge of the pressure plate 5 to the pivoting part 12 makes it easier for the pressure plate to execute a return movement into the relaxed plane initial position. The pressure plate 5 consists of an elastic material. In FIG. 6, the nut 23 is supported directly on the inner face of the carrier 21 to prevent rotation.

The adjusting device for pivoting the pressure plate can also be designed in another way. Thus, for example, the shaft 13 indicated in FIG. 1, corresponding to the shaft 25, 32 in FIG. 7, can be connected directly to the pressure plate 5, in order to adjust this. It is also possible to provide on this shaft 13 a helical groove of large pitch, into which a stud or a nut engages. This stud or the nut can be connected to a rod which leads outwards parallel to the shaft 13 and which is connected to an adjusting lever. As a result of the pivoting of the adjusting lever, the shaft 13 can be pivoted via the helical groove and the pressure plate 5 consequently adjusted.

I claim:

1. An adjustable chair backrest comprising:

a frame;

deformable material covering one side of said frame;

pivot means connected to said frame, said pivot means comprising a carriage fixed to said frame; a spindle journalled within said carriage and having one end extending outwardly and exteriorly of said frame; a movable nut threadingly engaging said spindle, said nut longitudinally movable with respect to an axis extending along said spindle in response to spindle rotation; and a cam located within said carriage and engaging said nut;

a pressure plate mounted to said cam, said pressure plate having a rigid lower portion and an elastically deformable upper portion;

whereby said plate and cam pivot about said axis upon longitudinal movement of said nut along said spindle in response to rotation of said spindle, said plate outwardly movable with respect to said frame and against said deformable covering.

2. The backrest defined in claim 1 wherein the plate has a plurality of slots extending along its upper portion.

3. The backrest defined in claim 1 wherein the upper portion of said plate has a plurality of lamellae.

4. The backrest defined in claim 1 further comprising a support extending across said frame and attached to the upper portion of said plate.

5. The backrest defined in claim 1 further comprising:

a rotary knob having a hub containing an open bore, said bore having a pin extending thereacross; and a sleeve mounted to said frame and having a hole sized to receive said hub, said hub engaging the extending end of said spindle, said spindle having a slot sized to closely receive said pin.

* * * * *